US011329423B2

(12) United States Patent
Chamura et al.

(10) Patent No.: US 11,329,423 B2
(45) Date of Patent: May 10, 2022

(54) ELECTRICAL CONNECTOR WITH A TURNABLE INSULATING COVER

(71) Applicant: HIROSE ELECTRIC CO., LTD., Kanagawa (JP)

(72) Inventors: Shingo Chamura, Kanagawa (JP); Marek Robert Policht, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 0 days.

(21) Appl. No.: 17/266,460

(22) PCT Filed: Jul. 12, 2019

(86) PCT No.: PCT/JP2019/027752
§ 371 (c)(1),
(2) Date: Feb. 5, 2021

(87) PCT Pub. No.: WO2020/036030
PCT Pub. Date: Feb. 20, 2020

(65) Prior Publication Data

US 2021/0296816 A1 Sep. 23, 2021

(30) Foreign Application Priority Data

Aug. 13, 2018 (JP) ..... JP2018-152298

(51) Int. Cl.
*H01R 13/58* (2006.01)

(52) U.S. Cl.
CPC ..... *H01R 13/5837* (2013.01); *H01R 13/5829* (2013.01)

(58) Field of Classification Search
CPC . H01R 13/5837; H01R 13/5829; H01R 13/58
USPC ..... 439/445
See application file for complete search history.

(56) References Cited

U.S. PATENT DOCUMENTS 5,211,706 A * 5/1993 Polgar ..... H01R 13/506 439/465
6,231,387 B1 * 5/2001 Kameyama ..... H01R 9/05 439/578
6,368,129 B1 * 4/2002 Wang ..... H01R 12/721 439/60

(Continued)

FOREIGN PATENT DOCUMENTS

JP 4-123070 U 11/1992
JP 10-241791 A 9/1998

(Continued)

*Primary Examiner* — Harshad C Patel
(74) *Attorney, Agent, or Firm* — Rankin, Hill & Clark LLP

(57) ABSTRACT

An electric connector includes a tubular conductive shell, covers provided outside the shell to cover at least part of the shell, and a movable cover coupled to the cover through a rotary shaft. The cover has locking pieces on a cable side. The movable cover has locking pieces to be engaged with the locking pieces. At least one of the locking piece or the locking piece includes multiple locking pieces arranged along a circumferential direction of a circle about the rotary shaft. The locking pieces and the locking pieces form a ratchet mechanism, and have such a structure that the locking pieces and the locking pieces are movable in an approaching direction and movement in a direction in which the locking pieces and the locking pieces are separated from each other is restricted.

6 Claims, 6 Drawing Sheets

(56) References Cited

U.S. PATENT DOCUMENTS

| | | | | |
|---|---|---|---|---|
| 7,201,604 | B1 * | 4/2007 | Amidon | H01R 13/5825 439/418 |
| 7,507,108 | B2 * | 3/2009 | Tsuji | H01R 13/5841 439/446 |
| 7,594,827 | B2 * | 9/2009 | Takamoto | A63F 13/98 439/353 |
| 7,794,267 | B2 * | 9/2010 | Daily | H01R 12/721 439/402 |
| 8,298,922 | B2 * | 10/2012 | Schumann | H01R 13/502 438/467 |
| 8,714,994 | B2 * | 5/2014 | Daily | H01R 24/64 439/344 |
| 9,509,067 | B2 * | 11/2016 | Yamauchi | H01R 9/0518 |
| 9,979,133 | B2 * | 5/2018 | De Dios | H01R 4/206 |
| 10,236,628 | B2 * | 3/2019 | Motohashi | H01R 13/6275 |
| 10,840,635 | B2 * | 11/2020 | Zellner | H01R 4/2433 |
| 2015/0280360 | A1 * | 10/2015 | Thelen | H01R 13/5837 439/465 |
| 2016/0268723 | A1 * | 9/2016 | Berengut | H01R 13/6392 |
| 2020/0378534 | A1 * | 12/2020 | Smith | H02G 3/0691 |

FOREIGN PATENT DOCUMENTS

| | | | |
|---|---|---|---|
| JP | 2011-60425 | A | 3/2011 |
| JP | 2015-191890 | A | 11/2015 |

* cited by examiner

ELECTRICAL CONNECTOR WITH A TURNABLE INSULATING COVER

TECHNICAL FIELD

The present invention relates to an electric connector, and specifically relates to an electric connector to which a shield-equipped multicore cable is connected.

BACKGROUND ART

For example, an electric connector for a shield-equipped multicore cable is used for electrically connecting signal lines to each other through a cable in various electronic devices such as a DVD device, an AV amplifier, a digital high-definition television, and a personal computer. Examples of the technique of the electric connector for the shield-equipped multicore cable include a technique described in Patent Literature 1 (JP-A-2011-60425). An electric connector described in Patent Literature 1 is a shield connector attached to a terminal of a multicore shield cable. In the multicore shield cable, multiple electric wires are covered with a braid, and the braid is covered with a sheath.

CITATION LIST

Patent Literature

PATENT LITERATURE 1: JP-A-2011-60425

SUMMARY OF INVENTION

Problems to be Solved by Invention

As a result of study conducted by the inventor(s) of the present invention, the following findings regarding the above-described electric connector technique have been obtained.

For example, even in the case of the same electric connector, the number of core wires of the multicore cable is not always the same. All pins are used in some cases, and only some of these pins are used in other cases. In these cases, a cable outer diameter size also changes according to a change in the number of core wires. Moreover, the thickness of the cable itself might change according to a cable to be used. Thus, an electric connector which can be reliably connected even if the number of core wires of a cable or the thickness of a cable is changed is necessary.

There is also a case where the process of connecting an electric connector and a cable to each other is performed on site. In this case, an electric connector accepting cables with various thicknesses is necessary. Moreover, it is also necessary to improve quality, reliability, and working efficiency in connection. That is, it is necessary to reliably fix the cable to the electric connector even if the entire thickness of the cable is changed and to avoid easy detachment of the cable even if tensile stress is applied to the cable. Further, an electric connector configured so that the connection process can be easily performed on site is necessary.

In the case of a shield-equipped multicore cable, the outer diameter of an external conductor (a braid) changes in association with a change in the number of core wires of a cable. Thus, an electric connector which can be reliably shield-connected even if the outer diameter of the external conductor is changed is necessary.

The present invention has been made for solving the above-described problems. One object of the present invention is to provide the technique of reliably easily making connection even in a case where the thickness of a cable is changed in an electric connector for a shield-equipped multicore cable.

The above-described object, other objects, and new features of the present invention will be apparent from description of the present specification and the attached drawings.

Solution to Problems

A brief summary of representative aspects of the invention disclosed in the present application is as follows.

That is, an electric connector according to the present invention is an electric connector to which a cable is connected, including: a housing configured to hold multiple terminals; a conductive shell provided outside the housing to cover at least part of the housing; an insulating first cover provided outside the shell to cover at least part of the shell; and a turnable insulating second cover coupled to the first cover through a rotary shaft, in which the first cover has a first locking piece on a cable side, the second cover has a second locking piece to be engaged with the first locking piece, at least one of the first locking piece or the second locking piece includes multiple locking pieces arranged along a circumferential direction of a circle about the rotary shaft, the first locking piece and the second locking piece have such a structure that the first locking piece and the second locking piece are movable in an approaching direction and movement in a separation direction is restricted in a state in which the first locking piece and the second locking piece are engaged with each other, the shell has, on the cable side, a first contact piece and a second contact piece for sandwiching an external conductor of the cable from both sides to contact the external conductor, and the second contact piece is positioned on a second cover side, and is deformable in a center axis direction of the cable to contact an inner wall surface of the second cover.

Further, each of the first locking piece and the second locking piece is configured such that a tip end portion thereof has a sawtooth shape facing an outside.

Moreover, a coupling portion is provided between the first locking piece and the first cover, and each of the first locking piece and the second locking piece is configured such that a tip end portion thereof has a sawtooth shape facing an outside in an X-Z plane.

Further, the second contact piece is configured such that a portion extending from the shell and positioned in a vicinity of the rotary shaft has a dented shape.

Moreover, each of the first contact piece and the second contact piece has a contact surface along a tangent line of an outer circumferential circle of the external conductor, and the contact surface is formed in such a manner that an end portion of the first contact piece or the second contact piece is bent.

Still further, on the cable side, each of the first cover and the second cover has, on an inner wall surface thereof, a protrusion for biting an external insulator of the cable to fix the cable.

Effects of Invention

A brief summary of advantageous effects obtained by the representative aspects of the invention disclosed in the present application is as follows.

(1) Even if the thickness of the cable is changed according to the number of core wires, connection is reliably easily made by the same electric connector.

(2) The electric connector accepting various cables with different cable thicknesses can be provided.

(3) the process of connecting the electric connector and the cable to each other on site is reliably easily performed.

DESCRIPTION OF EMBODIMENTS

Figure 1:
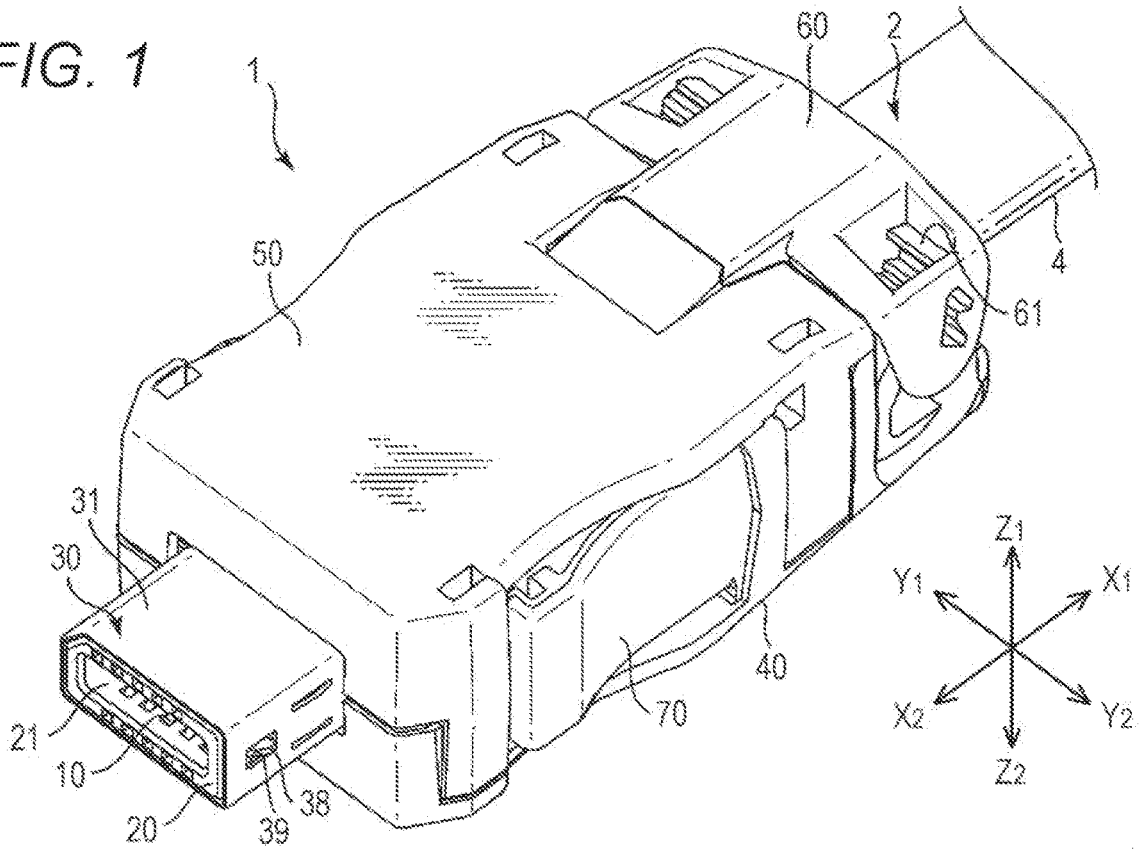
FIG. 1 is an entire perspective view of a configuration of an electric connector according to one embodiment of the present invention.

Hereinafter, an embodiment of the present invention will be described in detail based on the attached drawings. Note that in all figures for describing the embodiment, the same reference numerals are used to represent the same members in principle, and repeated description thereof will be omitted.

For the sake of convenience, in the embodiment described below, multiple divided sections or embodiments will be described as needed. Unless otherwise clearly specified, these sections or embodiments are not unrelated to each other. There is a relationship in which one of the section or the embodiment is a variation, detailed description, supplemental description or the like of part or the entirety of the other one of the section or the embodiment. In a case where the number of elements or the like (including a number, a numerical value, an amount, a range or the like) are described in the embodiment described below, the number of elements is not limited to a particular number, unless otherwise clearly specified or clearly limited to the particular number in principle. The number of elements may be equal to or greater than or equal to or less than the particular number.

Figure 2:
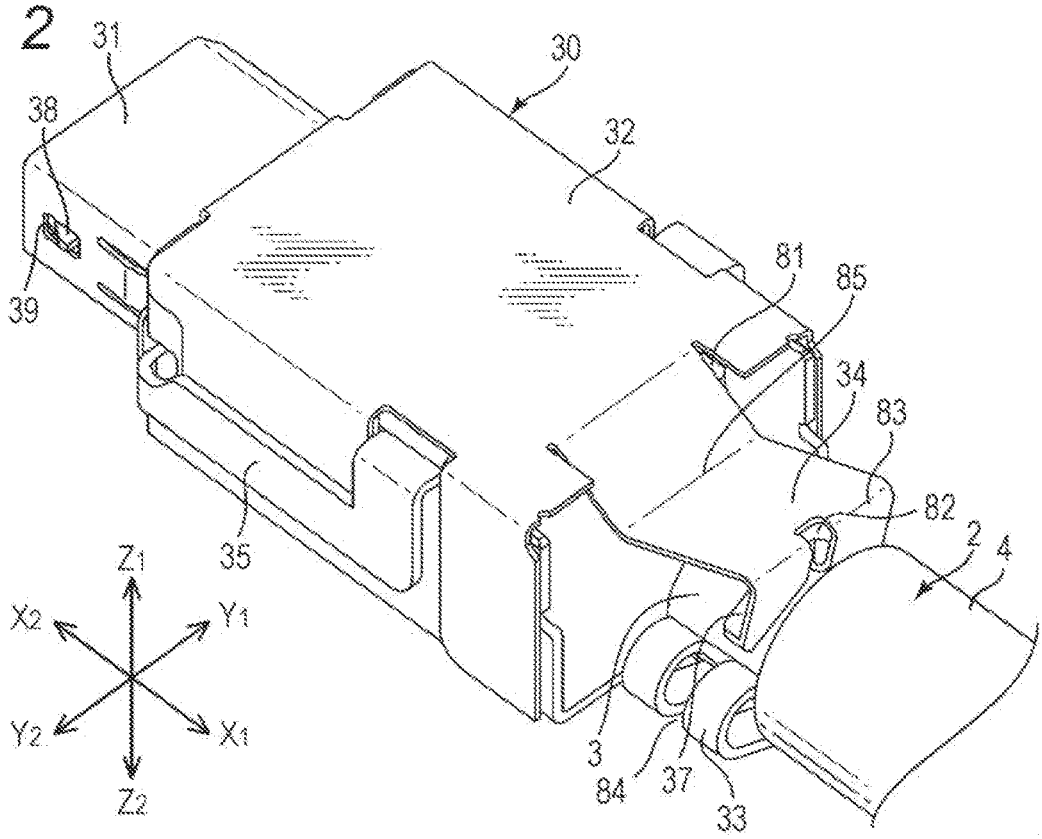
FIG. 2 is a perspective view in a state in which covers, a movable cover, and an operation unit of the electric connector illustrated in FIG. 1 are removed.
Figure 3:
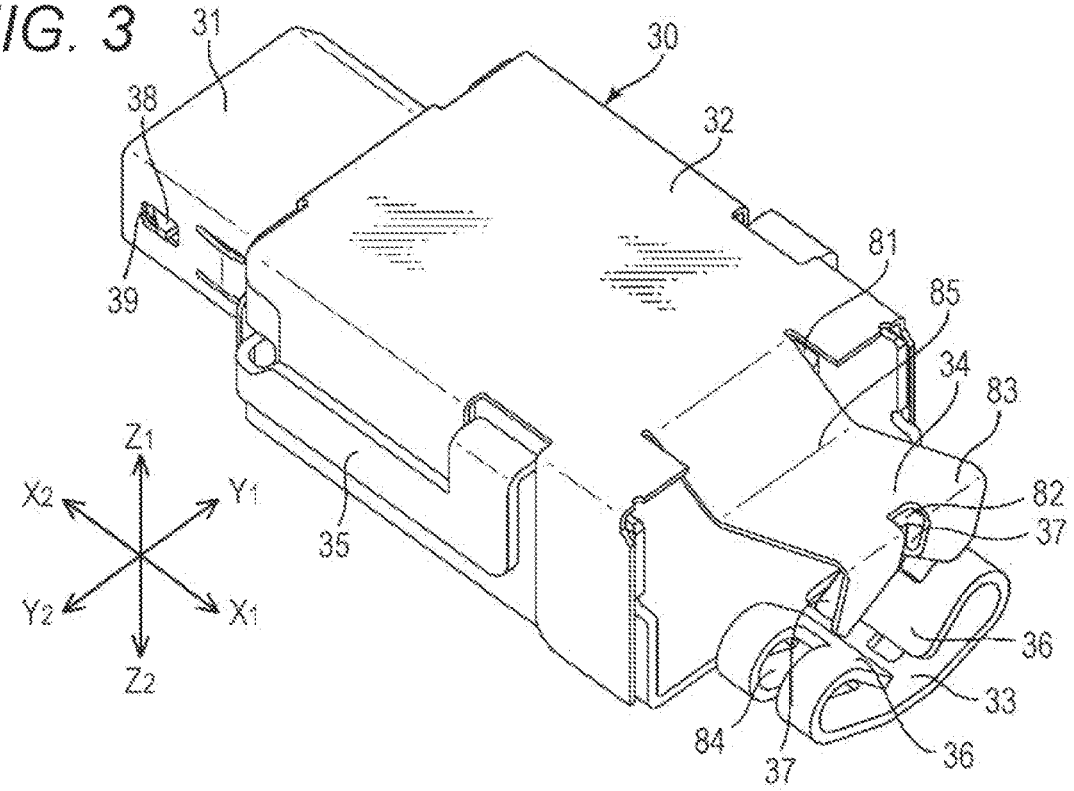
FIG. 3 is a perspective view in a state in which the covers, the movable cover, the operation unit, and a cable of the electric connector illustrated in FIG. 1 are removed.
Figure 4:
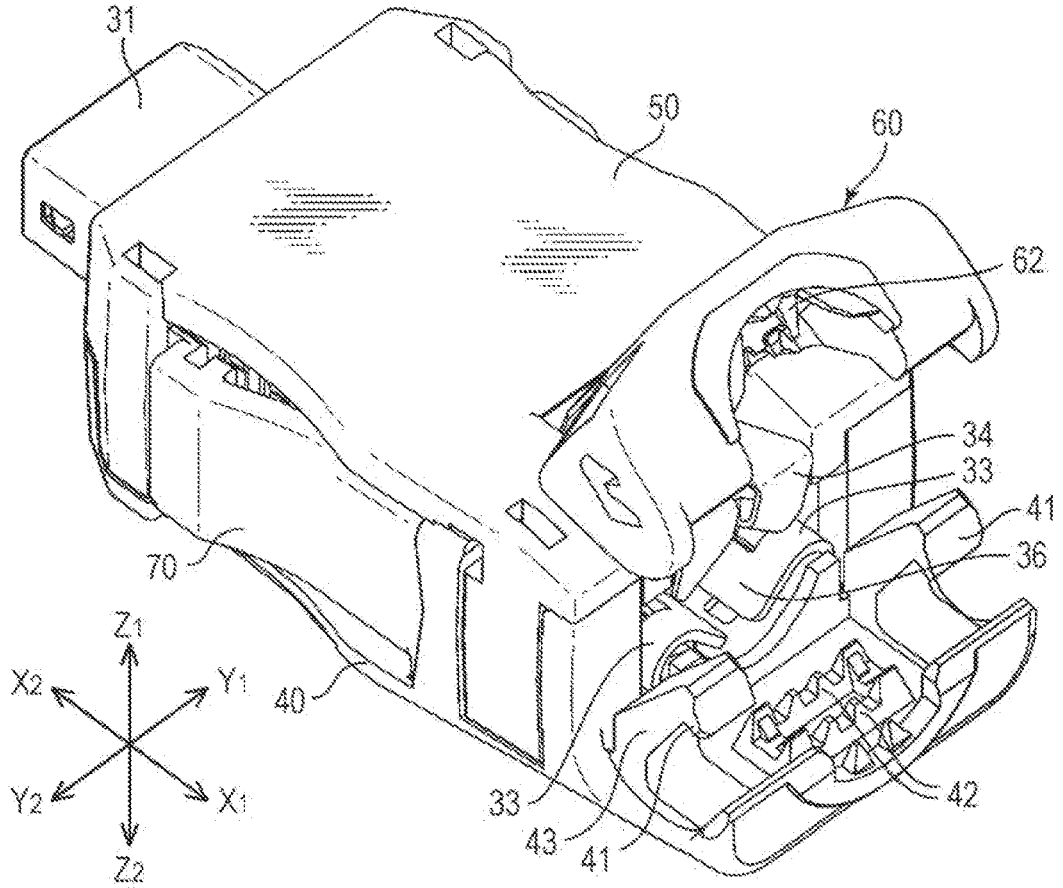
FIG. 4 is a perspective view in a state in which the cable of the electric connector illustrated in FIG. 1 is removed and the movable cover is opened.

FIG. 1 is an entire perspective view of a configuration of an electric connector according to one embodiment of the present invention. FIG. 2 is a perspective view in a state in which covers, a movable cover, and an operation unit of the electric connector illustrated in FIG. 1 are removed. FIG. 3 is a perspective view in a state in which the covers, the movable cover, the operation unit, and a cable of the electric connector illustrated in FIG. 1 are removed. FIG. 4 is a perspective view in a state in which the cable of the electric connector illustrated in FIG. 1 is removed and the movable cover is opened.

First, one example of the configuration of the electric connector according to one embodiment of the present invention will be described with reference to FIGS. 1 to 4. As illustrated in FIG. 1, the electric connector 1 of the present embodiment is a cable connector to which a shield-equipped multicore cable 2 is connected. The electric connector 1 includes multiple terminals 10, a housing 20 to which the terminals 10 are fixed, a tubular conductive shell 30 covering an outer portion of the housing 20, the insulating covers 40, 50 (first covers) provided outside the shell 30 to cover at least part of an outer portion of the shell 30, the insulating movable cover 60 (a second cover) coupled to the cover 50 through a rotary shaft 63, and the insulating operation unit 70.

As illustrated in FIGS. 1 and 2, the shield-equipped multicore cable 2 includes multiple core wires (not shown) each electrically connected to the terminals 10, a braid 3 (an external conductor) covering the outside of the multiple core wires and electrically connected to the shell 30, and an insulating outer cover 4 (an external insulator) covering the outside of the braid 3.

The multiple terminals 10 are each electrically connected to terminals of a partner connector (not shown) in contact with these terminals upon fitting to the partner connector. The multiple terminals 10 are made of conductive metal. FIG. 1 illustrates 10 terminals in total, five terminals being provided on each of upper and lower sides. Note that the number of terminals is not limited to such a number and is changed according to the type of connector.

The housing 20 is formed of an insulating member such as resin. The housing 20 includes grooves and holes to which the multiple terminals 10 are fixed. Moreover, the housing 20 includes a fitting recessed portion 21 to be fitted to the partner connector.

The shell 30 covers the outside of the housing 20, and as clearly illustrated in FIGS. 2 and 3, includes a fitting portion 31 provided on a fitting side (a $X_2$ direction) and fitted to the partner connector, a body shell 32, a lower contact piece 33 (a first contact piece) and an upper contact piece 34 (a second contact piece) provided on a cable side (a $X_1$ direction), and two elastic operation pieces 35 provided on both lateral sides (a $Y_1Y_2$ direction) of the body shell 32. The shell 30 is formed in such a manner that a metal plate is punched and bent. The lower contact piece 33 and the upper contact piece 34 are for sandwiching the braid 3 of the cable 2 from both sides (an upper-lower direction $Z_1Z_2$) such that the lower contact piece 33 and the upper contact piece 34 are electrically connected to the braid 3 in contact therewith, and have elasticity. Moreover, the upper contact piece 34 is, in a center axis direction (a $Z_2$ direction) of the cable 2, deformable to be pushed down in contact with an inner wall surface of the movable cover 60.

The lower contact piece 33 is provided on a cover 40 side (the $Z_2$ direction), and is positioned between the cover 40 and the braid 3. The lower contact piece 33 is formed integrally with the shell 30. The lower contact piece 33 has such a shape that the lower contact piece 33 extends from the shell 30 to the cable side (the $X_1$ direction), is separated toward both sides in a transverse direction (the $Y_1Y_2$ direction), and is bent (in a heart shape) with a curvature toward the upper side (a $Z_1$ direction). Two right and left slits 84 are provided at such a bent portion, and accordingly, the elasticity of the lower contact piece 33 is adjusted. As clearly illustrated in FIG. 3, the lower contact piece 33 has, at a tip end portion thereof, two right and left contact surfaces 36 along a tangent line of an outer circumferential circle of the braid 3. The contact surface 36 is formed in such a manner that an end portion of the lower contact piece 33 is bent. The contact surface 36 is provided along a fitting direction (an $X_1X_2$ direction). With the contact surfaces 36, the area of contact with a surface of the braid 3 is increased, and biting of the surface of the braid 3 with the lower contact piece 33 is prevented. Thus, electric connection is reliably made, and damage of the braid 3 is prevented.

The upper contact piece 34 is provided on a movable cover 60 side (the $Z_1$ direction), and is positioned between the movable cover 60 and the braid 3. The upper contact piece 34 is formed integrally with the shell 30. The upper contact piece 34 has such a shape that the upper contact piece 34 extends from the shell 30 to the cable side, has a dented middle portion 85 in the vicinity of the rotary shaft 63, further extends and branches into two portions bent in the center axis direction (the $Z_2$ direction) of the cable at a bent surface 83, and is further bent in a shell-30-side direction (the $X_2$ direction). A slit 82 is provided further ahead of the bent portion (the bent surface 83). The elasticity of the upper contact piece 34 can be adjusted in such a manner that the dimensions of the slit 82 are changed. Moreover, the upper contact piece 34 has, at a tip end portion thereof, two right and left contact surfaces 37 along the tangent line of the outer circumferential circle of the braid 3. The contact surface 37 is formed in such a manner that an end portion of the upper contact piece 34 is bent. The contact surface 37 is provided along a circumferential direction of the cable 2. With the contact surfaces 37, the area of contact with the surface of the braid 3 is increased, and biting of the surface of the braid 3 with the upper contact piece 34 is prevented. Thus, electric connection is reliably made, and damage of the braid 3 is prevented. Moreover, two cutout portions 81 are provided on both sides of a joint portion between the body shell 32 and the upper contact piece 34, and by changing the lengths of these cutout portions 81, the elasticity of the upper contact piece 34 can be adjusted.

The contact surfaces 36 of the lower contact piece 33 and the contact surfaces 37 of the upper contact piece 34 are formed along the fitting direction (the $X_1X_2$ direction), and are arranged facing each other in the upper-lower direction (a $Z_1Z_2$ direction). As illustrated in FIGS. 5A to 7D, the positions of the contact surfaces 37 in the upper-lower direction (the $Z_1Z_2$ direction) change according to the thickness of the cable. However, in any of FIGS. 5C, 6C, and 7C, the contact surfaces 37 are positioned within the area of the contact surface 36 in the fitting direction (the $X_1X_2$ direction). With this configuration, even in the case of cables with different thicknesses, the braid 3 (the external conductor) of the cable 2 can be reliably held by the contact surfaces 37 and the contact surfaces 36, and electric connection can be reliably made.

The elastic operation pieces 35 are two elastic pieces extending from both side surfaces of the body shell 32 in the fitting direction (the $X_2$ direction). The elastic operation pieces 35 are used for locking and unlocking upon fitting to the partner connector. Two lock protruding portions 38 elastically protruding to both sides are provided at tip end portions of the elastic operation pieces 35 on the fitting side (the $X_2$ direction). With this configuration, a structure is formed, in which the lock protruding portions 38 protrude from lock holes 39 formed at both side surfaces of the fitting portion 31 of the shell 30. Upon fitting to the partner connector, the lock protruding portions 38 are hooked on and locked in lock holes (not shown) of the partner connector. For unlocking for cancelling fitting to the partner connector, the operation unit 70 is pushed in from both sides. Two elastic operation pieces 35 deform inwardly accordingly, and two lock protruding portions 38 are drawn into the lock holes 39. In this manner, hooking on the lock holes of the partner connector is cancelled, and unlocking is performed.

As clearly illustrated in FIGS. 4 to 7D, the cover 40 has, on an inner wall surface thereof on the cable side (the $X_1$ direction), multiple protrusions 42 for biting the outer cover 4 of the cable 2 to fix the cable 2. In the present embodiment, 2×2 protrusions 42 are provided at positions facing protrusions 62 of the movable cover 60. However, the present invention is not limited to such a configuration, and the number of protrusions 42 may be any number. On the cable side (the $X_1$ direction) of the cover 40, two locking pieces 41 (first locking pieces) are provided on both sides. The locking piece 41 is configured such that a tip end portion thereof has a sawtooth shape facing the outside (the $Z_2$ direction).

The movable cover 60 includes the rotary shaft 63 formed integrally with the movable cover 60 (see FIGS. 5A to 7D). The rotary shaft 63 is fitted in a groove (a shaft receiver 51) of the cover 50, and in this manner, the movable cover 60 is coupled to the cover 50 to rotate about the rotary shaft 63.

As clearly illustrated in FIGS. 4 to 7D, the movable cover 60 has, on the inner wall surface thereof on the cable side (the $X_1$ direction), the protrusions 62 for biting the outer cover 4 of the cable 2 to fix the cable 2. In the present embodiment, 2×2 protrusions 62 are provided at positions facing the protrusions 42 of the cover 40. However, the present invention is not limited to such a configuration, and the number of protrusions 62 may be any number.

The movable cover 60 has, on each side thereof, three locking pieces 61 (second locking pieces) to be engaged with the locking pieces 41. 3×2 locking pieces 61 are configured such that tip end portions thereof have a sawtooth shape facing the outside (the $Z_1$ direction). 3×2 locking pieces 61 are preferably arranged along a circumferential direction of a circle about the rotary shaft 63. The locking pieces 41 and the locking pieces 61 form a ratchet mechanism. The locking pieces 41 and the locking pieces 61 have such a structure that the locking pieces 41 and the locking pieces 61 are movable in an approaching direction and movement in a separation direction is restricted in a state in which the locking pieces 41 and the locking pieces 61 are engaged with each other.

A coupling portion 43 coupling the locking piece 41 and the cover 40 has elasticity. The coupling portions 43 elastically deforms to the fitting side (an $X_2$ side) in an X-Z plane when the locking piece 41 and the locking piece 61 are engaged with each other. Thus, the ratchet mechanism can be made. Moreover, by adjusting the thickness of the coupling portion 43, easiness of displacement of the locking piece 41 can be also adjusted. If the coupling portion 43 is too thick, the coupling portion 43 is less likely to warp, and it is difficult to engage the locking piece 41 with the locking piece 61. Conversely, if the coupling portion 43 is too thin, the coupling portion 43 easily warps, and engagement with the locking piece 61 is facilitated. Note that the locking piece 41 and the locking piece 61 engaged with each other are more likely to be separated from each other.

Note that in the present embodiment, the configuration having one locking piece 41 and three locking pieces 61 on each side is described so that adjustment can be made in three steps. However, the present invention is not limited to such a configuration, and the configuration may have one locking piece 41 and multiple (two or more) locking pieces 61, may have multiple (two or more) locking pieces 41 and one locking piece 61, or may have multiple (two or more) locking pieces 41 and multiple (two or more) locking pieces 61.

Figure 5A:
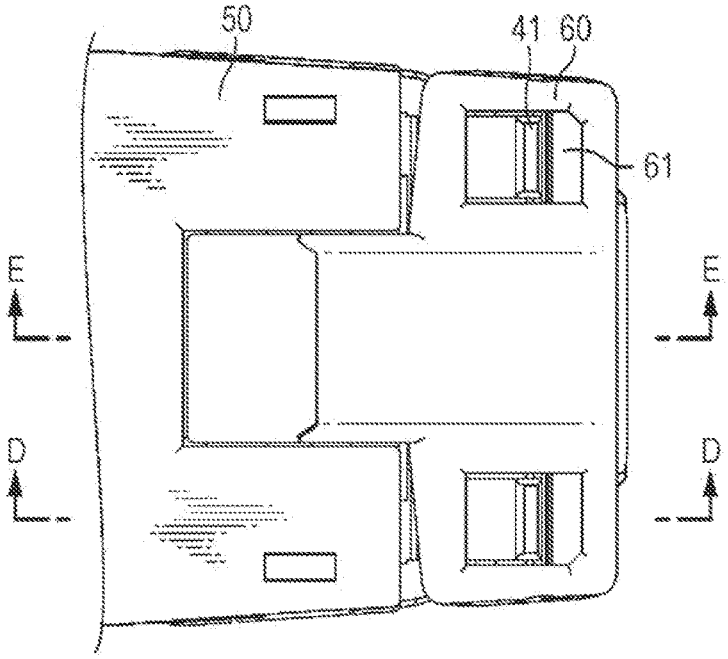
FIG. 5A is a view (part of the cable and the connector is omitted) of a movable cover position relationship in a case where a large-diameter cable is connected, FIG. 5A being a plan view.
Figure 5B:
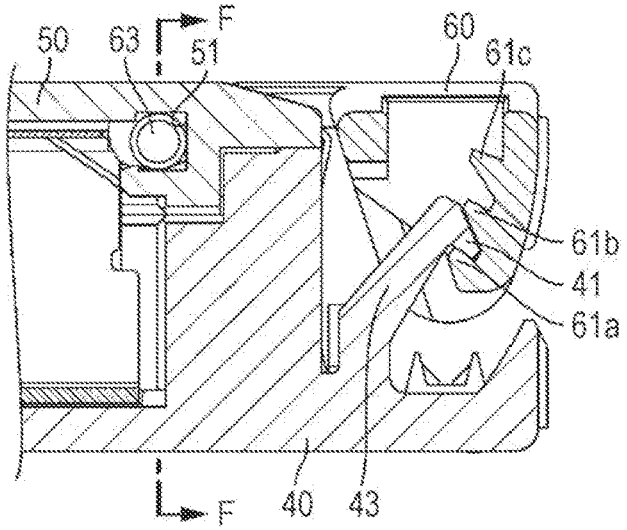
FIG. 5B is a view (part of the cable and the connector is omitted) of the movable cover position relationship in a case where the large-diameter cable is connected, FIG. 5B being a sectional view in a D-D cut plane.
Figure 5C:
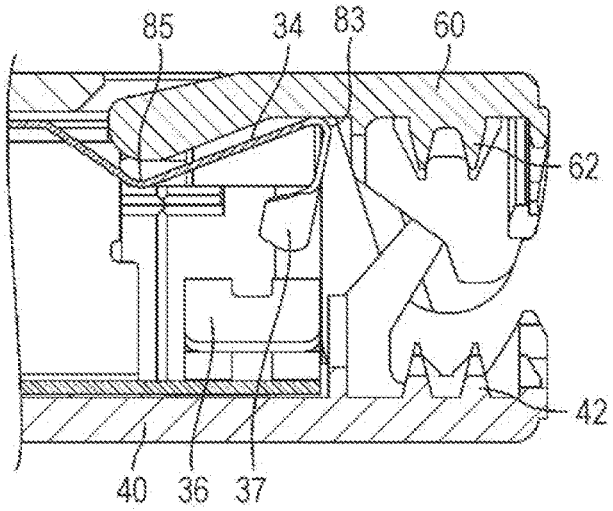
FIG. 5C is a view (part of the cable and the connector is omitted) of the movable cover position relationship in a case where the large-diameter cable is connected, FIG. 5C being a sectional view in an E-E cut plane.
Figure 5D:
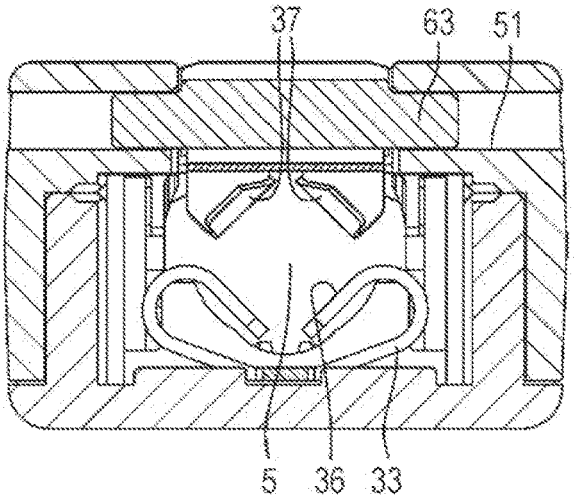
FIG. 5D is a view (part of the cable and the connector is omitted) of the movable cover position relationship in a case where the large-diameter cable is connected, FIG. 5D being a sectional view in an F-F cut plane.
Figure 6A:
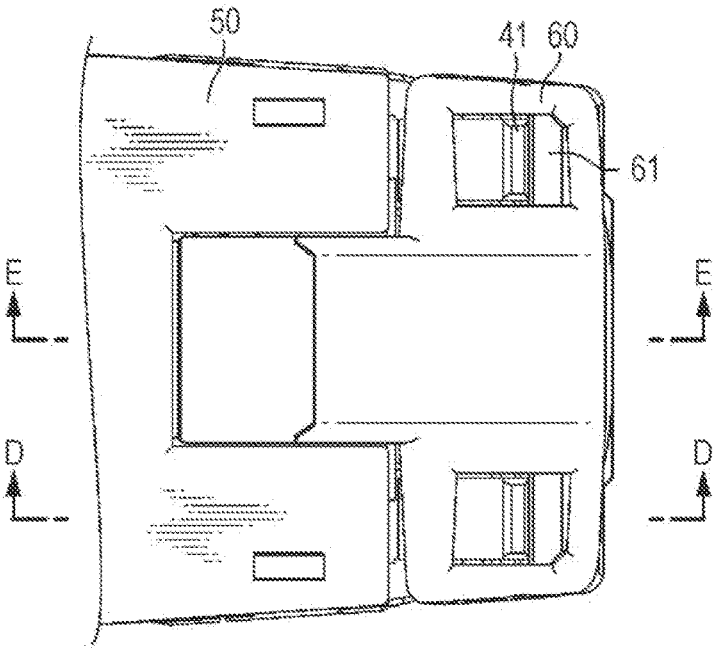
FIG. 6A is a view (part of the cable and the connector is omitted) of a movable cover position relationship in a case where an intermediate-diameter cable is connected, FIG. 6A being a plan view.
Figure 6B:
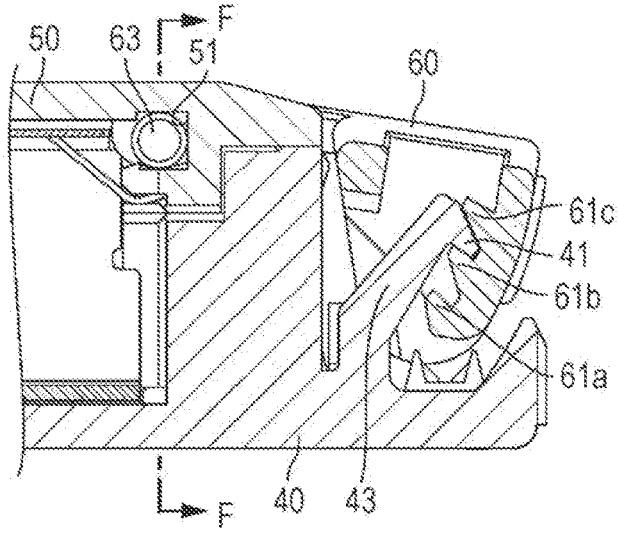
FIG. 6B is a view (part of the cable and the connector is omitted) of the movable cover position relationship in a case where the intermediate-diameter cable is connected, FIG. 6B being a sectional view in a D-D cut plane.
Figure 6C:
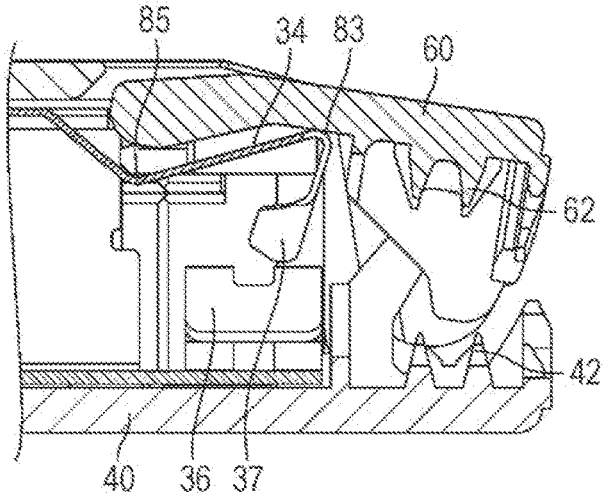
FIG. 6C is a view (part of the cable and the connector is omitted) of the movable cover position relationship in a case where the intermediate-diameter cable is connected, FIG. 6C being a sectional view in an E-E cut plane.
Figure 6D:
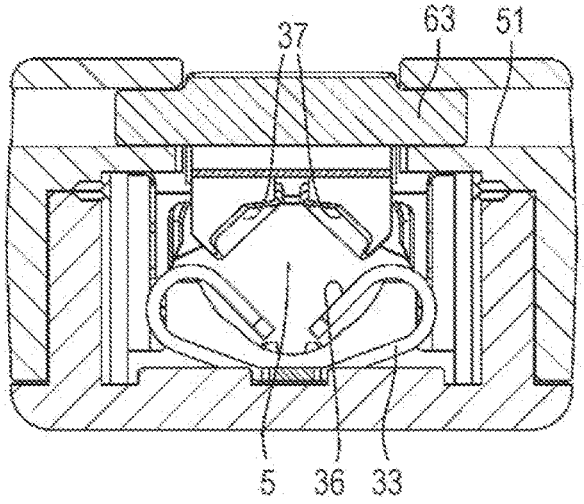
FIG. 6D is a view (part of the cable and the connector is omitted) of the movable cover position relationship in a case where the intermediate-diameter cable is connected, FIG. 6D being a sectional view in an F-F cut plane.
Figure 7A:
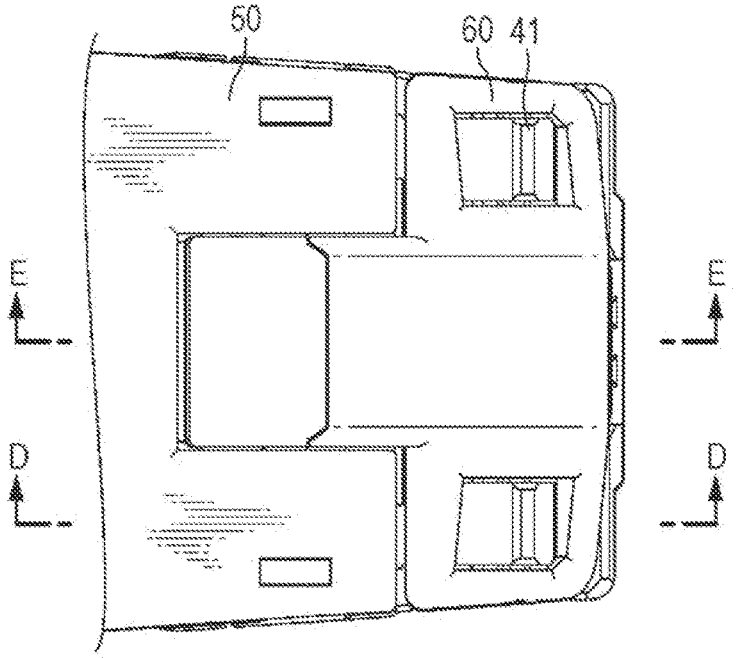
FIG. 7A is a view (part of the cable and the connector is omitted) of a movable cover position relationship in a case where a small-diameter cable is connected, FIG. 7A being a plan view.
Figure 7B:
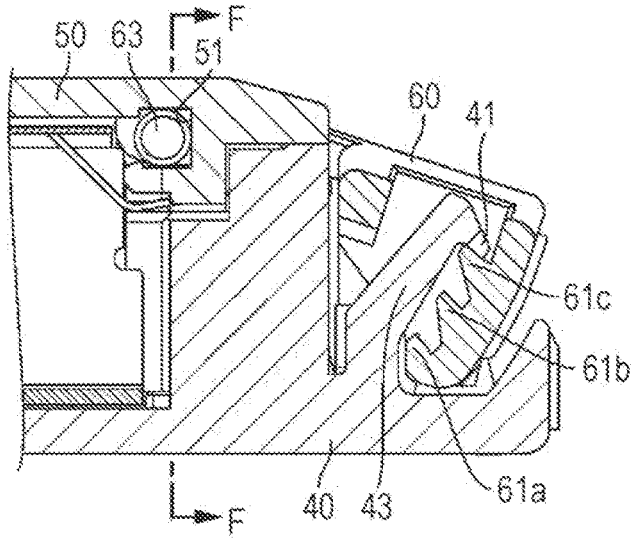
FIG. 7B is a view (part of the cable and the connector is omitted) of the movable cover position relationship in a case where the small-diameter cable is connected, FIG. 7B being a sectional view in a D-D cut plane.
Figure 7C:
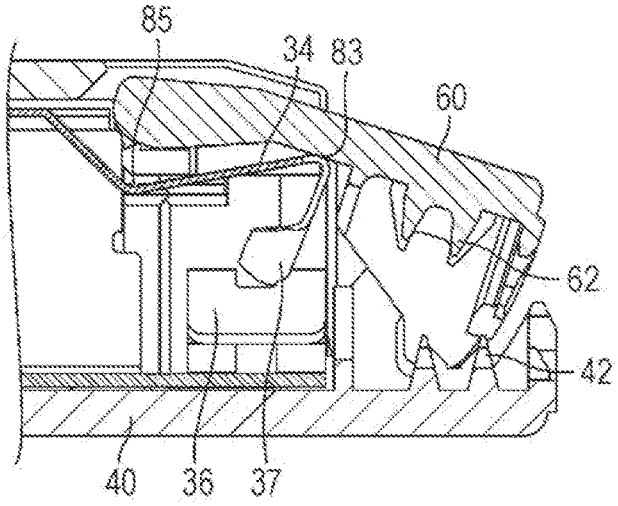
FIG. 7C is a view (part of the cable and the connector is omitted) of the movable cover position relationship in a case where the small-diameter cable is connected, FIG. 7C being a sectional view in an E-E cut plane.
Figure 7D:
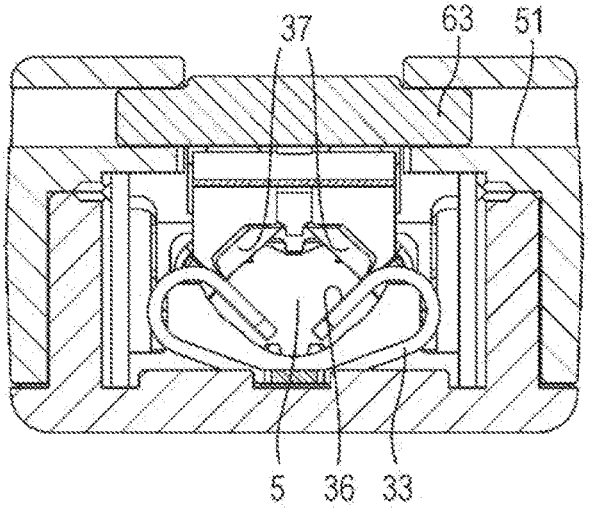
FIG. 7D is a view (part of the cable and the connector is omitted) of the movable cover position relationship in a case where the small-diameter cable is connected, FIG. 7D being a sectional view in an F-F cut plane.

Next, the method for connecting the electric connector of the present embodiment in the case of different cable thicknesses will be described with reference to FIGS. 5A to 7D. FIGS. 5A to 7D are views (part of the cable and connector is omitted) illustrating a movable cover position relationship. FIGS. 5A, 6A, and 7A are plan views. FIGS. 5B, 6B, and 7B are sectional views in a D-D cut plane. FIGS. 5C, 6C, and 7C are sectional views in an E-E cut plane. FIGS. 5D, 6D, and 7D are sectional views in an F-F cut plane. FIGS. 5A to 5D illustrate a case where a large-diameter cable is connected. FIGS. 6A to 6D illustrate a case where an intermediate-diameter cable is connected. FIGS. 7A to 7D illustrate a case where a small-diameter cable is connected.

As illustrated in FIGS. 5A to 5D, in a case where the thick cable is connected to the electric connector 1, rotary movement about the rotary shaft 63 is performed in the direction (the $Z_2$ direction) of closing the movable cover 60 from a state in which the movable cover 60 is opened as illustrated in FIG. 4. Accordingly, the locking pieces 41 of the cover 40 and locking pieces 61*a* of the movable cover 60 are engaged with each other, and the cable 2 is fixed. At the same time, the bent surface 83 of the upper contact piece 34 is pushed down in contact with an inner wall of the movable cover 60, and the contact surfaces 37 come into contact with the surface of the braid 3. Accordingly, the braid 3 of the cable 2 is also fixed. At this point, since the locking pieces 41 have surfaces inclined to an outer direction (the $Z_2$ direction) and the locking pieces 61 have surfaces inclined to the outer direction (the $Z_1$ direction), movement only in the direction of closing the movable cover 60 is allowed, and movement in an opening direction is restricted (the so-called ratchet mechanism). Such movement is stopped in a state in which the locking pieces 41 and the locking pieces 61*a* are engaged with each other because the cable is thick. Moreover, the contact surfaces 36 and the contact surfaces 37 sandwich the braid 3 of the cable 2 from both sides in the upper-lower direction ($Z_1Z_2$). Thus, electric connection between the shell 30 and the braid 3 can be reliably made. Further, the contact surfaces 36 and the contact surfaces 37 are arranged at substantially symmetrical positions with respect to an axial direction ($X_1X_2$) of the braid 3. Thus, shield performance can be enhanced. Further, the protrusions 42 and the protrusions 62 bite the outer cover 4 to sandwich the outer cover 4 from both sides of the cable 2 in the upper-lower direction ($Z_1Z_2$). Thus, the cable 2 is reliably fixed.

As illustrated in FIGS. 6A to 6D, in a case where the cable with an intermediate thickness is connected to the electric connector 1, rotary movement about the rotary shaft 63 is performed in the direction (the $Z_2$ direction) of closing the movable cover 60 from the state in which the movable cover 60 is opened as illustrated in FIG. 4. Accordingly, the locking pieces 41 of the cover 40 and locking pieces 61*b* of the movable cover 60 are engaged with each other, and the cable 2 is fixed. At the same time, the bent surface 83 of the upper contact piece 34 is pushed down in contact with the inner wall of the movable cover 60, and the contact surfaces 37 come into contact with the surface of the braid 3. Accordingly, the braid 3 of the cable 2 is also fixed. At this point, since the locking pieces 41 have the surfaces inclined to the outer direction (the $Z_2$ direction) and the locking pieces 61 have the surfaces inclined to the outer direction (the $Z_1$ direction), movement only in the direction of closing the movable cover 60 is allowed, and movement in the opening direction is restricted (the so-called ratchet mechanism). The locking pieces 61*a* move over mountain-shaped portions of the locking pieces 41 and movement is stopped in a state in which the locking pieces 41 and the locking pieces 61*b* are engaged with each other because the cable has the intermediate thickness. Moreover, the protrusions 42 and the protrusions 62 bite the outer cover 4 to sandwich the outer cover 4 from both sides of the cable 2 in the upper-lower direction ($Z_1Z_2$). Thus, the cable 2 is reliably fixed.

As illustrated in FIGS. 7A to 7D, in a case where the thin cable is connected to the electric connector 1, rotary movement about the rotary shaft 63 is performed in the direction (the $Z_2$ direction) of closing the movable cover 60 from the state in which the movable cover 60 is opened as illustrated in FIG. 4. Accordingly, the locking pieces 41 of the cover 40 and locking pieces 61*c* of the movable cover 60 are engaged with each other, and the cable 2 is fixed. At the same time, the bent surface 83 of the upper contact piece 34 is pushed down in contact with the inner wall of the movable cover 60, and the contact surfaces 37 come into contact with the surface of the braid 3. Accordingly, the braid 3 of the cable 2 is also fixed. At this point, since the locking pieces 41 have the surfaces inclined to the outer direction (the $Z_2$ direction) and the locking pieces 61 have the surfaces inclined to the outer direction (the $Z_1$ direction), movement only in the direction of closing the movable cover 60 is allowed, and movement in the opening direction is restricted (the so-called ratchet mechanism). The locking pieces 61*a*, 61*b* move over the mountain-shaped portions of the locking pieces 41 and movement is stopped in a state in which the locking pieces 41 and the locking pieces 61*b* are engaged with each other because the cable is thin. Moreover, the protrusions 42 and the protrusions 62 bite the outer cover 4 to sandwich the outer cover 4 from both sides of the cable 2 in the upper-lower direction ($Z_1Z_2$). Thus, the cable 2 is reliably fixed.

As described above, by rotary movement of the movable cover 60 upon connection of the cable, the cable can be reliably fixed according to the thickness of the cable (three steps in the present embodiment). That is, as illustrated in FIGS. 5A to 7D, a cable space 5 changes according to the thickness of the cable 2. Note that in the present embodiment, three locking pieces 61 are provided on each side so that adjustment can be made in three steps. On this point, four locking pieces 61 are provided so that adjustment can be made in four steps. The number of locking pieces 61 is changed so that adjustment can be performed in optional steps. Even if the number of locking pieces 41 and the number of locking pieces 61 are set in an opposite way, similar advantageous effects are obtained. When the multiple locking pieces 41 and the multiple locking pieces 61 are arranged, these pieces are preferably arranged along the circumference of the circle about the rotary shaft 63. As in the present embodiment, the locking pieces 41 and the locking pieces 61 are preferably provided in pairs on both right and left sides (the $Y_1Y_2$ direction).

Thus, according to the electric connector of the present embodiment, even if the thickness of the cable changes according to the number of core wires, connection is reliably easily made by the same electric connector. Moreover, according to the electric connector of the present embodiment, an electric connector accepting various cables with different cable thicknesses can be provided. Further, according to the electric connector of the present embodiment, on-site cable connection is easily made for cables with various thicknesses.

The invention made by the inventor(s) of the present invention has been specifically described above based on the embodiment thereof. Note that the present invention is not limited to the above-described embodiment, and needless to say, various changes can be made without departing from the gist of the present invention.

INDUSTRIAL APPLICABILITY

The present invention can be utilized for various electric connectors for coupling industrial devices to each other, such as a communication cable.

LIST OF REFERENCE SIGNS

1 Electric connector
2 Cable
3 Braid (external conductor)
4 Outer cover (external insulator)
5 Cable space
10 Terminal
20 Housing
21 Fitting recessed portion
30 Shell
31 Fitting portion
32 Body shell
33 Lower contact piece (first contact piece)
34 Upper contact piece (second contact piece)
35 Elastic operation piece
36 Contact surface
37 Contact surface
38 Lock protruding portion
39 Lock hole
40 Cover (first cover)
41 Locking piece (first locking piece)
42 Protrusion
43 Coupling portion
50 Cover (first cover)
51 Shaft receiver
60 Movable cover (second cover)
61 Locking piece (second locking piece)
62 Protrusion
63 Rotary shaft
70 Operation unit
81 Cutout portion
82 Slit
83 Bent surface
84 Slit
85 Intermediate portion

The invention claimed is:

1. An electric connector to which a cable is connected, comprising:

a housing configured to hold multiple terminals;

a conductive shell provided outside the housing to cover at least part of the housing;

an insulating first cover provided outside the shell to cover at least part of the shell; and a turnable insulating second cover coupled to the first cover through a rotary shaft, wherein the first cover has a first locking piece on a cable side, the second cover has a second locking piece to be engaged with the first locking piece, at least one of the first locking piece or the second locking piece includes multiple locking pieces arranged along a circumferential direction of a circle about the rotary shaft, the first locking piece and the second locking piece have such a structure that the first locking piece and the second locking piece are movable in an approaching direction and movement in a separation direction is restricted in a state in which the first locking piece and the second locking piece are engaged with each other, the shell has, on the cable side, a first contact piece and a second contact piece for sandwiching an external conductor of the cable from both sides to contact the external conductor, and the second contact piece is positioned on a second cover side, and is deformable in a center axis direction of the cable to contact an inner wall surface of the second cover.

2. The electric connector according to claim 1, wherein each of the first locking piece and the second locking piece is configured such that a tip end portion thereof has a sawtooth shape facing an outside.

3. The electric connector according to claim 1, wherein a coupling portion is provided between the first locking piece and the first cover, and each of the first locking piece and the second locking piece is configured such that a tip end portion thereof has a sawtooth shape facing an outside in an X-Z plane.

4. The electric connector according to claim 1, wherein the second contact piece is configured such that a portion extending from the shell and positioned in a vicinity of the rotary shaft has a dented shape.

5. The electric connector according to claim 1, wherein each of the first contact piece and the second contact piece has a contact surface along a tangent line of an outer circumferential circle of the external conductor, and the contact surface is formed in such a manner that an end portion of the first contact piece or the second contact piece is bent.

6. The electric connector according to claim 1, wherein on the cable side, each of the first cover and the second cover has, on an inner wall surface thereof, a protrusion for biting an external insulator of the cable to fix the cable.

* * * * *